United States Patent [19]

Hilfiker et al.

[11] Patent Number: 4,505,621

[45] Date of Patent: Mar. 19, 1985

[54] WIRE RETAINING WALL APPARATUS AND METHOD FOR EARTHEN FORMATIONS

[75] Inventors: Harold K. Hilfiker; Arthur L. Hilfiker, both of Eureka, Calif.

[73] Assignee: Hilfiker Pipe Co., Eureka, Calif.

[21] Appl. No.: 497,867

[22] Filed: May 25, 1983

[51] Int. Cl.[3] ..... E02D 5/00

[52] U.S. Cl. ..... 405/284; 405/258

[58] Field of Search ..... 405/284, 258, 262, 272, 405/285, 286

[56] References Cited

U.S. PATENT DOCUMENTS 4,117,686 10/1978 Hilfiker ..... 405/284

4,341,491 7/1982 Neumann ..... 405/284

4,391,557 7/1983 Hilfiker et al. ..... 405/287 X

*Primary Examiner*—Dennis L. Taylor

*Attorney, Agent, or Firm*—Limbach, Limbach & Sutton

[57] ABSTRACT

A retaining wall for an earthen formation (E) is provided by welded wire grid work trays (T) having floor sections (10) which are embedded in the formation and face sections (12) which are disposed at the face of the formation. The trays (T) are superimposed one above the other with the edges of the face sections (12) secured together. An improved construction comprising preformed kinked extensions (18) secures the face sections (12) together without the necessity of separate fasteners, or the plastic deformation of the tray wires.

9 Claims, 3 Drawing Figures

WIRE RETAINING WALL APPARATUS AND METHOD FOR EARTHEN FORMATIONS

BACKGROUND OF THE INVENTION

The present invention relates to the retention of earthen formations and, more particularly, is concerned with a retaining and reinforcing mechanism made up for welded wire grid work trays. In its more specific aspects, the invention is concerned with an improved method and construction for securing the face sections of such trays together, without the necessity of separate fasteners or plastic deformation of the tray wires.

The prior art relating to the present invention is exemplified by U.S. Pat. No. 4,117,686 to William K. Hilfiker. That patent discloses a method and apparatus for constructing retaining walls from welded wire grid work trays of the type with which the present invention is concerned. In the structure of the patent, the face sections of the trays are secured together either through means of separate ties, or by plastically deforming the distal wires of the face sections as a wall is erected. Another form of wire retention wall may be seen in French Pat. No. 7507114, published Oct. 1, 1976. In the structure of that patent, wire trays have U-shaped face sections which are superimposed upon one another and, in at least some instances, secured together with wire ties.

SUMMARY OF THE INVENTION

The welded wire trays employed in the present invention each have an elongate floor section and a face section extending at an angle relative to the floor section. Each tray comprises longitudinal wires extending continuously over the length thereof and across the floor and face sections, and cross wires welded to and extending across said longitudinal wires. The improved construction of the invention comprises extensions on the longitudinal wires which extend from the distal ends of the face section in generally coplanar relation thereto, and protrusions formed on at least some of the extensions adjacent the distal end of the face section, said protrusions extending laterally relative to the plane of the face section. In use, the extensions of one tray are engaged with retention means carried by the face sections of an adjacent tray, with one of the cross wires of the adjacent tray retained beneath the protrusion.

A principal object of the invention is to provide an apparatus and method for securing the face sections of a welded wire retention wall together, without the necessity of plastically deforming the wires of the face sections.

Yet another object related to the latter object is to provide such an apparatus and method wherein the plating or coating provided to protect the wires of the wall from corrosion will not be broken in the course of securing the face sections together.

Still another object is to provide such a method and apparatus which may be installed without the necessity of employing tools to plastically deform the wire of the wall.

A further object of the invention is to provide such a method and apparatus which assures secure connection between the face sections.

Another object of the invention is to provide such a method and apparatus wherein the welded wire elements of the wall and the connecting structure provided to secure the face sections together may be preformed prior to placement of the elements within an earthen formation to be retained and reinforced.

A further object of the invention is to provide such a method and apparatus wherein the preforming of the connection structure may be effected prior to the application of a protective corrosion resistant coating to the wires of the elements.

These and other objects will become more apparent when viewed in light of the following detailed description and accompanying drawings.

DESCRIPTION OF THE PREFERRED EMBODIMENT

Figure 1:
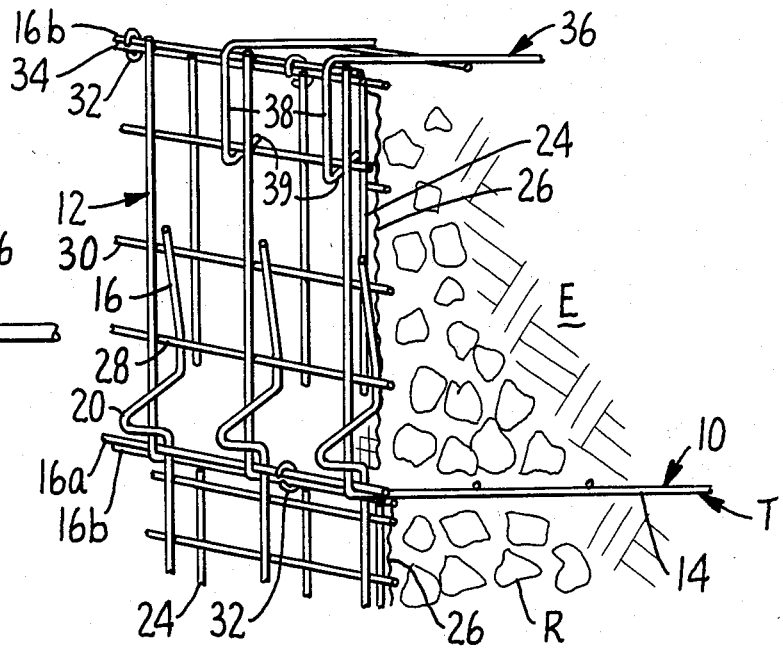
FIG. 1 is a perspective view, with parts thereof broken away and shown in section, illustrating an earthen formation retained through means of a wall constructed according to the present invention.

Referring now to the drawings, an earthen formation "E" is shown retained by a wall constructed according to the present invention. The wall comprises a plurality of generally L-shaped welded wire gird work trays "T", each of which has a floor section 10 and a face section 12. In the preferred embodiment, the trays are fabricated of five, seven or nine guage wire, having two by six inch spacing. After formation of the grid works into the L-shaped configuration of the trays, with the extensions hereinafter described, the wires are coated with an anti-corrosive coating, such as galvanizing, zinc dip or epoxy.

Each tray comprises longitudinally extending wires 14 extending continuously over the length thereof and across the floor and face sections in spaced generally parallel relationship to one another. Transverse or cross wires 16 are welded to and extend across the longitudinally extending wires 14. In the preferred embodiment illustrated, one of said cross wires is a corner wire **16*a* disposed at the fold line between the floor and face sections. Another of said cross wires, designated 16*b***, is disposed at the distal end of the face section.

Elongate ends or extensions 18 formed as continuations of the wires 14 extend from the distal ends of the face sections in generally coplanar relationship thereto. Each of these extensions is provided with a protrusion intermediate the length thereof in the form of a forwardly extending kink 20 disposed adjacent and to the outside of the cross wire **16*b*. The kinks 20 extend laterally from the extensions 20** and out of the plane of the face sections. Although only one tray having such extensions is illustrated, it is to be understood that all of the trays beneath the uppermost tray would have such extensions and that the extensions of each tray would cooperate with the tray thereabove as shown in the drawings. The uppermost trays are not provided with such extensions.

In use, the earthen formation to be retained by the wall would first be excavated to provide an area for placement of the wall. The lowermost tray would then be positioned at the bottom of the area with the floor section in generally horizontal relationship. Backfill would then be placed to hold the floor section in position. Then a first coarse grid mat 24 would be placed to the inside of the face section of the tray and a second fine grid mat 26 would be placed to the inside of the first mat. In the preferred embodiment illustrated, the first mat would be of the same two-inch by six-inch grid spacing as the trays, with the two-inch spacing extending horizontally and transversely relative to the two-inch spacing of the tray grids. The second mat would ideally be in the form of a screen having approximately a one-fourth inch square grid. With the mats placed, and after the next tray is secured and anchored thereabove, the placement of earthen and rock backfill is completed by loading it through said next tray, with rock backfill "R" against the back of the second mat.

Figure 2:
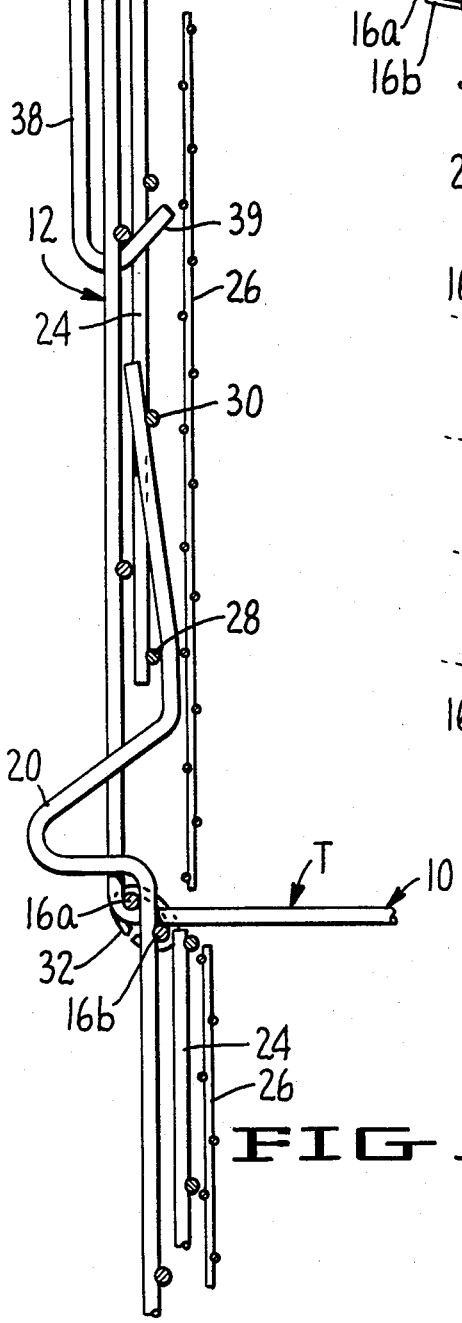
FIG. 2 is a cross-sectional elevational view of a wall constructed according to the invention.
Figure 3:
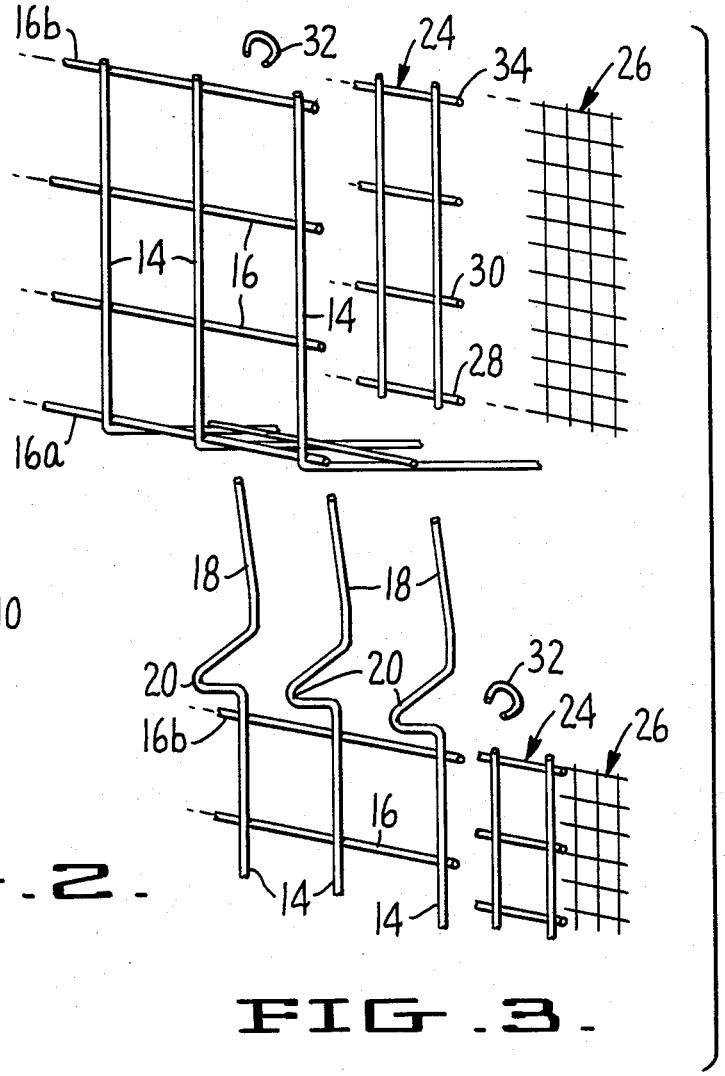
FIG. 3 is an exploded perspective view illustrating the components of a wall constructed according to the invention.

Once the backfill over the first tray was substantially complete, the second tray would be positioned as shown in FIG. 2. In thus positioning the tray, the extensions 18 of the lowermost tray are threaded through the second tray so as to pass to the inside and over the cross wires 16*a* of the second tray. As so positioned, the longitudinally extending wires of the floor section of the second tray are supported on the cross wire 16*b* of the lowermost tray and the cross wire 16*a* of the second tray is captured beneath the protrusion kink 20 of the lowermost tray. With the second tray so positioned, a first mat 24 is threaded over the extensions of the lowermost tray so that the lowermost cross wire 28 of the mat is disposed to one side of the extensions and the next cross wire 30 of the mat is disposed to the other side of the extensions. Thus, the extensions are captured between the cross wires of the mat 24, as may be seen in the upper portion of FIG. 2. The first mat is then secured to the second tray, as by hog rings 32. As shown, the hog rings 32 extend around an uppermost cross wire 34 of the mat 24 and the uppermost cross wire 16*b* of the face section of the second tray. Once the first mat is so secured to the second tray, the second fine grid mat 26 is disposed to the inside of the first mat and backfill comprised of rock and earth is placed within the second tray, with the rock behind the face of the tray, as may be seen from FIG. 1.

The foregoing steps of placing a second tray above the tray therebeneath, placing first and second mats to the inside of the second tray and backfilling the second tray are repeated until the wall is erected to the desired height. When the wall is one tray layer short of its upper extremity, an uppermost tray without extensions 18 is used to complete the final run of trays. The placement of such an uppermost tray is identical to that of the trays therebeneath. Final tray placement is different, however, in that a flat tray 36 having hook segments 38 is positioned at the top of the wall, with the hooked ends extending around the uppermost cross wires 16*b* of the face section therebeneath and to the front of said face section. Angled distal ends 39 on the hook segments 38 engage beneath the penultimate cross wire 16 on the face section to secure the trays 36 in place. The engagement of the ends 39 may be seen from FIGS. 1 and 2. The flat tray 36 is fabricated of a welded wire grid work corresponding to that used for the tray "T".

The extensions of the respective trays are threaded through the trays thereabove without plastic deformation of the extensions. Thus, the corrosion preventing coating on the extensions is not fractured as the result of bending. The hook segments 38 on the trays 36 are formed prior to application of the corrosion resistant coating thereto and the distal ends 39 are not bent during the placement of the tray 36. Thus, the coating on the tray 36 is also not likely to be fractured during the course of placement.

The hog rings 32 are used primarily as a matter of convenience and, in the ultimate wall, do not perform a load carrying function. Once the backfill is in place, it serves to hold the mats 24 and 26. In use, only a few hog rings are used for each mat so as to temporarily hold it in place prior to placement of the backfill. It is possible to manually hold the mats 24 in place as the backfill is placed and, thus, avoid the use of the hog rings. It is also anticipated that the cross wires on the face sections may be so spaced as to be directly engageable with opposite sides of the extensions 18. Such engagement would function to secure the respective face sections together, without the necessity of the mats 24.

CONCLUSION

While a preferred embodiment of the invention has been illustrated and described, it should be understood that the invention is not intended to be limited to the specifics of this embodiment, but rather is defined by the accompanying claims.

What is claimed is:

1. In a retaining wall for earthen formations comprising wire trays having floor and face sections with a fold line therebetween, an improved construction for connecting the distal end of the face section of a first such tray to the fold line of a second such tray, said construction comprising: a transverse wire fixed to and extending across the distal end of the face section of the first tray; a plurality of wires fixed to and extending longitudinally of said face section, said plurality of wires having elongate ends extending longitudinally from the distal end of said face section in generally coplanar relationship thereto and at least certain of said ends having a protrusion intermediate the length thereof extending laterally therefrom and out of the plane of said face section at a location adjacent said distal end; a corner wire fixed to and extending across said second tray at the fold line thereof, the floor section of said second tray being supportable on the transverse wire of the first tray with the protrusions of the first tray engaged over the corner wire of the second tray; and, means to retain the corner wire of the second tray in engagement beneath the protrusions of the first tray.

2. In a retaining wall according to claim 1, the improved construction wherein the means to retain the corner wire comprises a wire grid attachable to the face section of the second tray, said grid being engageable with opposite sides of the plurality of wires of the first tray to embrace said wires and hold the face section of the first tray in general alignment with the face section of the second tray.

3. In a retaining wall according to claim 1, the improved construction wherein the protrusions comprise kinks in at least certain of the elongate ends of said plurality of wires.

4. In a retaining wall according to claim 1 wherein the trays have longitudinal wires extending continuously over the length thereof and across said floor and face sections in spaced generally parallel relationship to one another, the improved construction wherein said plurality of wires comprise extensions of said longitudinally extending wires.

5. In a wire tray for the retention of earthen formations, said tray having an elongate floor section and a face section extending at an angle relative to the floor section and comprising longitudinal wires extending continuously over the length thereof and across said floor and face sections, in spaced generally parallel relationship to one another, and cross wires welded to and extending across said longitudinal wires in spaced relationship to one another, the improved construction for securing said tray to a similar adjacent tray, comprising: elongate end extensions on said longitudinal wires extending longitudinally from the distal end of the face section in generally coplanar relationship thereto; and, protrusions formed on at least some of said extensions intermediate the length thereof and adjacent to the distal end of the face section, said protrusions extending laterally from the extensions out of the plane of the face section.

6. In a wire tray according to claim 5 wherein a cross wire is disposed at the distal end of the face section, the improved construction wherein the protrusions are disposed immediately adjacent to said cross wire.

7. In a wire tray according to claim 6, the improved construction wherein the protrusions comprise kinks formed in the extensions.

8. In a retaining wall for an earthen formation comprising welded wire grid work trays having floor sections for embedment in the formation and face sections extending at an angle relative to the floor sections for disposition at the face of the formation, an improved method of securing the face sections of such trays in edge-to-edge relationship to one another, said method comprising: providing elongate wire extensions on the distal ends of the face sections, said extensions extending longitudinally from the face sections in generally coplanar relationship thereto and having preformed protrusions extending laterally therefrom out of the plane of the face sections, said protrusions being adjacent said distal ends; threading the extensions of the face section of one of said trays into the face section of an adjacent tray so that the face of said adjacent tray rests on the face section of said one tray and the protrusions of said one tray are engaged over a cross wire of said adjacent tray.

9. In a retaining wall according to claim 8, the improved method wherein the step of threading the extensions is effected without plastic deformation of the extensions.

* * * * *